United States Patent [19]

Goble

[11] Patent Number: 4,858,695

[45] Date of Patent: Aug. 22, 1989

[54] SAFE ENTRY APPARATUS

[75] Inventor: Jon A. Goble, Beech Grove, Ind.

[73] Assignee: Goble, Fiorenza & Tenan, A partnership, Beech Grove, Ind.

[21] Appl. No.: 72,717

[22] Filed: Jul. 13, 1987

[51] Int. Cl.[4] ..... A62C 35/12

[52] U.S. Cl. ..... 169/62; 169/70; 239/283; 285/12

[58] Field of Search ..... 169/62, 70, 51, 52, 169/54, 66, 67, 68, 89; 239/282, 283, 279; 285/12, 67, 325, 311, 312, 313, 314, 315, 316, 317, 363

[56] References Cited

U.S. PATENT DOCUMENTS

| | | | |
|---|---|---|---|
| 761,950 | 6/1904 | Dreifuss | 285/317 |
| 797,152 | 8/1905 | Sheckler | 285/12 |
| 2,055,590 | 9/1936 | Pugnet | 169/70 |
| 2,535,311 | 12/1950 | McGann | 169/70 |
| 2,560,269 | 7/1951 | Berner . | |
| 2,576,143 | 11/1951 | Rochet . | |
| 2,807,479 | 9/1957 | Hixon | 169/70 |
| 3,079,937 | 3/1963 | Tooper et al. | 239/282 |
| 3,623,752 | 11/1971 | Brown | 285/12 |
| 3,731,954 | 5/1973 | Hagland | 285/12 |
| 3,972,373 | 8/1976 | Nichols et al. | 169/62 |
| 4,147,216 | 4/1979 | Schnepfe et al. | 169/70 |
| 4,197,914 | 4/1980 | Grey | 169/51.12 |
| 4,372,395 | 2/1983 | Hammett | 169/62 |
| 4,485,877 | 12/1984 | McMillan et al. | 169/48.52 |
| 4,545,604 | 10/1985 | Braathen | 285/12 |
| 4,646,848 | 3/1987 | Bruensicke | 169/89 |

*Primary Examiner*—Sherman D. Basinger
*Assistant Examiner*—Thomas J. Brahan
*Attorney, Agent, or Firm*—E. Victor Indiano

[57] ABSTRACT

A safe entry apparatus is mountable in a first compartment on a wall separating the first compartment from a second compartment. The apparatus is provided for receiving a nozzle to permit a fluid from the nozzle to be transferred into the second compartment. The apparatus includes a housing having first end, a second end, and a passageway extending between the first end and the second end. A nozzle receiver is disposed adjacent to the second end of the housing for receiving the nozzle. The nozzle receiver includes a cavity into which the end of the nozzle can be inserted. The cavity is in fluid communication with the passageway. A pair of gate members are mounted to the housing and are movable between a nozzle releasing position to permit the nozzle to be received into the cavity, and a nozzle engaging position for gripping the nozzle to secure the nozzle in the cavity.

26 Claims, 4 Drawing Sheets

SAFE ENTRY APPARATUS

BACKGROUND OF THE INVENTION

The present invention relates to a firefighting apparatus, and more particularly to a firefighting apparatus for use in a compartmentalized structure, such as a ship. The fire fighting apparatus of the present invention permits an operator standing in a first compartment of the ship to fight a fire burning in a second compartment of the ship. Through this arrangement, the device reduces the danger to the operator when entering the second compartment, and helps to reduce the likelihood that the fire in the second compartment will spread into the first compartment.

Fire is one of the greatest dangers facing those aboard a ship. Part of the danger of a ship-board fire results from the compartmentalized nature of the interior of most ships.

As will be appreciated by those familiar with ships, and especially warships, the interior of a ship is usually divided by bulkheads into a series of watertight compartments. These bulkheads serve as walls, floors and ceilings which define the "rooms" or compartments of a ship. Typically, doors are utilized to enable the ship's personnel to move between laterally adjacent compartments, and hatches are utilized to enable personel to move between vertically adjacent compartments. These doors, hatches and bulkheads are designed to make the individual compartments water tight, so that if a compartment becomes flooded with water, the compartment can be sealed off to prevent the water from intruding into other compartments. Confining the intrusion of water to a localized area substantially reduces the likelihood of an amount of water entering the ship sufficient to sink it.

When a fire erupts in a compartment of a ship, this compartmentalization can impede the fighting of the fire in the compartment. For example, the heat from the fire in a compartment may make it difficult or impossible to open a closed compartment door (or hatch) to enter the burning compartment to extinguish the fire. Additionally, it may be inadvisable to open the compartment door or hatch in such a situation, because by opening the door the fire may spread into an adjacent compartment.

The current procedure utilized to fight a fire in a closed compartment is to direct the spray from a fire hose on to the door of the burning compartment until the door reaches a temperature low enough to permit the firefighters to open the door. The time spent in cooling the door can permit the fire to cause damage which could have been prevented if the time spent cooling the door was not being spent on cooling the door, but instead was spent on applying water (or other fire extinguishing agent) directly on to the fire affected area.

Another problem attendant to the fighting of shipboard fires is the danger caused by exposure to the fire. When a firefighter approaches a fire in a compartment, he faces the possibility of injury from the fire, and from shrapnel caused by exploding articles in the compartment. If a firefighter could extinguish a fire without being forced to enter into the burning compartment, the likelihood of the firefighter being so injured would be reduced substantially. Even if the firefighter cannot extinguish the fire in the burning compartment completely while standing in an adjacent compartment, the risk of injury is reduced substantially by providing a water curtain in the burning compartment adjacent to the door or hatch of the compartment.

Therefore, one object of the present invention is to provide a device which permits a person standing in a first compartment to introduce a fire extinguishing agent into a second compartment to help fight a fire therein.

SUMMARY OF THE INVENTION

In accordance with the present invention, a safe entry apparatus, is provided which is mountable in a first compartment on a wall in a structure containing the first compartment and a second compartment. The apparatus is provided for receiving a nozzle to permit a fluid from the nozzle to be transferred into the second compartment. The apparatus comprises a housing having a first end, a second end and a passageway extending between the first end and the second end. A nozzle receiving means is disposed adjacent to the second end of the housing for receiving the nozzle. The nozzle receiving means includes a cavity into which the end of the nozzle can be inserted. The cavity is in fluid communication with the passageway. A gate means is provided mounted to the housing and is movable between a nozzle releasing position to permit the nozzle to be received into the cavity, and a nozzle engaging position for gripping the nozzle to secure the nozzle in the cavity.

Preferably, the nozzle receiving means includes a removable adapter means mounted in the cavity. The adapter means includes an axially outwardly facing surface which is contoured for receiving the end of the nozzle in a generally watertight relation. Additionally, the gate means preferably comprises first and second gate members, each of which includes a radially inwardly facing surface for engaging a side surface of the nozzle, a generally arcuate concave lip surface for engaging an axially outwardly facing surface of the nozzle and a track follower means for following a track on the housing to permit the gate members to slide between the nozzle releasing and nozzle engaging positions.

One feature of the present invention is that the device includes a nozzle receiving means adapted to receive the types of nozzles used currently on many ships. This feature has the advantage of reducing the cost of utilizing the device, as special nozzles need not be purchased for use with the device. Additionally, the ability of the device to be used with conventional nozzles reduces the cost of outfitting ships currently in service by obviating the need to replace the ship's existing nozzles.

Another feature of the present invention is that the device can include interchangable nozzle adapters and gate members. The use of interchangable nozzle adapters and gates has the advantage of facilitating the manufacturing process by permitting the manufacturer to make a standard housing structure which, through the use of specially adapted nozzle adapters and gates, will fit a wide variety of nozzle types. Additionally, the use of interchangable nozzle adapters and gate members facilitates the refitting of ships with new nozzles, as only a part of the safe entry apparatus need be changed to fit the new nozzles, not the entire device.

It is also a feature of the present invention that slidable gate members are employed to secure the nozzle to the apparatus. The slidable gate members have the advantage of providing a secure, generally watertight attachment between the nozzle and the apparatus, while being easy for the operator to use.

Additional features and advantages of the present invention will become apparent to those skilled in the art upon consideration of the following detailed description of the preferred embodiments exemplifying the best mode of carrying out the invention as perceived presently.

DETAILED DESCRIPTION OF THE INVENTION

Figure 1:
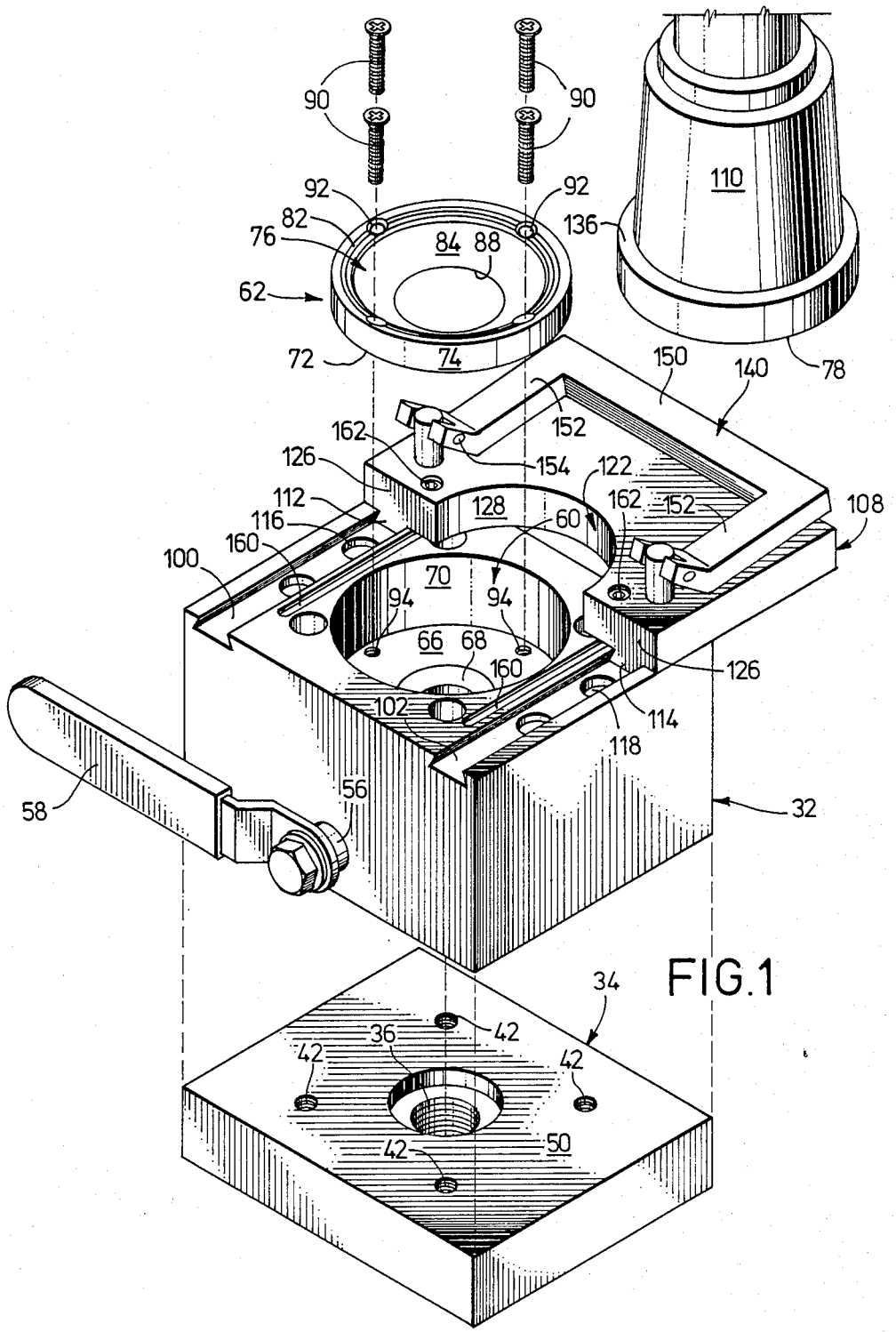
FIG. 1 is an exploded, perspective view of the apparatus of the present invention.

A safe entry apparatus 10 is shown in the drawings which can be mounted on to a wall such as a bulkhead 12, which separates a first compartment 14 from a second compartment 16. For structural reasons, the bulkheads 12 on military vessels are typically between 0.25 and 0.375 inches thick.

The safe entry apparatus 10 includes a housing 26, having a first end 28 which is mounted to the bulkhead 12, and a second end 30 adapted for receiving the nozzle 20. The housing 26 includes a valve housing member 32 and an end plate 34. The end plate 34 is attached to the bulkhead 12 by bolts (not shown) and includes a threaded central bore 36 which is aligned with an aperture 40 in the bulkhead 12. Alternatively, the end plate 34 can be welded to the bulkhead 12. The end plate 34 also includes threaded openings 42 for receiving mounting bolts 44 which secure together the end plate 34 and valve housing 32.

Preferably, the end plate 34 and valve housing 32 are made from a corrosion resistant material which will withstand high temperatures without melting or deforming. Examples of such materials include brass and stainless steel.

The valve housing portion 32 of the housing 26 includes an inner end face 48 which is disposed adjacent to, and in an opposed relation to the outer end face 50 of the end plate 34. The valve housing portion 32 defines a passageway 52 extending in an axial direction therethrough to permit fluid from the nozzle 20 to pass through the valve housing portion 32. The passageway 52 is aligned with the threaded central bore 36 of the end plate 34, so that the fluid can pass entirely through the apparatus 10, from the nozzle 20 in the first compartment 14 to the sprinkler system 24 in the second compartment 16.

A ball valve 54 is mounted in the passageway 52 for controlling the flow of fluid through the passageway 52. An arm 56 is fixedly coupled to, and extends from the ball valve 54 in a direction normal to the direction of the passageway 52. The arm 56 terminates exteriorly of the valve housing portion 32 and is coupled to a valve handle 58 to permit the user to move the ball valve 54 between an open and a closed position.

The use of a valve, such as ball valve 54 is not necessary to the operation of the apparatus 10. However, it is highly recommended, as the placement of a valve 54 in the apparatus 10 maintains the watertight integrity of the compartments 14,16. Without the use of a valve, water would be able to flow between the compartments 14,16 by traveling through the apparatus 10 and sprinkler system 24. Thus, when the apparatus 10 is not in use, the valve 54 should be placed in its closed position in order to maintain the watertight integrity of the compartments 14,16.

A nozzle receiving means is disposed at the second end 30 of the valve housing portion 32. The nozzle receiving means includes two principal components, a cavity 60 which is formed in the second end 30 of the valve housing portion 32, and an adapter 62 which is insertable in the cavity 60.

As shown in the drawings, the cavity 60 is generally disk shaped, having a generally planar axially outwardly facing surface 66. The axially outwardly facing surface 66 includes an annular beveled portion 68 which surrounds the axially outer opening of the passageway 52.

The cavity 60 also includes a radially inwardly facing side wall surface 70. Surface 70 preferably comprises a right cylindrical segment having a diameter large enough to receive the largest diameter nozzle 20 typically found on ships, so that a "standard" valve housing 32 will accomodate a large variety of nozzle configurations.

Figure 2:
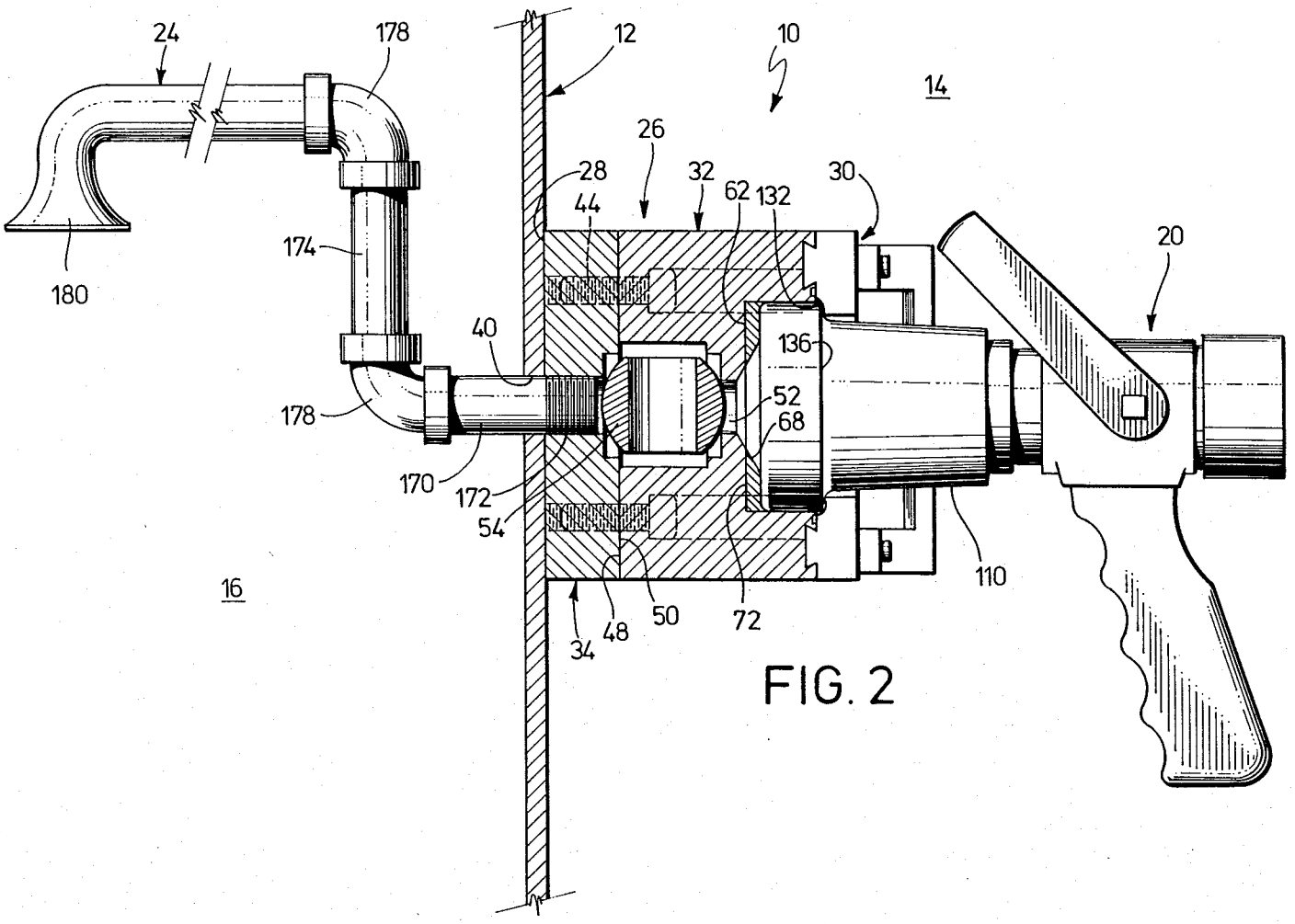
FIG. 2 is a side, partially sectional view of the apparatus of the present invention installed on a bulkhead.

The adapter 62 includes an axially inwardly facing surface 72 configured to mate with the axially outwardly facing surface 66 of the cavity 60, and a radially outwardly facing surface 74 having a diameter sized to be snuggly received against the radially inwardly facing surface 70 of the cavity 60. The adapter 62 also includes an axially outwardly facing surface 76 which is contoured to receive the end face 78 of the nozzle 20 in a generally watertight relation. The adapter 62 shown in FIGS. 1 and 2 is especially adapted to fit the so called "Variable Nozzle", which is the current nozzle of choice of military naval vessels.

The axially outwardly facing surface 76 of the adapter 62 includes an outer ridged portion 82 and an inner beveled portion 84. The outer ridged portion 82 contains a series of ridges and troughs. The ridges are provided for engaging the soft rubber end face 78 of the nozzle 20 in a deforming relation to provide a generally watertight seal between the end face 78 of the nozzle 20, and the adapter 62. The beveled inner portion 84 helps to direct the flow of water from the nozzle 20 into the central aperture 88 of the adapter 62. The central aperture 88 is aligned with the axially outer end of the passageway 52 so that water flowing through the central aperture 88 flows into and through the passageway 52.

The adapter 62 is secured to the valve housing 32 by removable fasteners, such as screws 90, which extend through counter-sunk apertures 92 formed in the outer ridged portion 82 of the adapter 62. The screws 90 extend through the counter-sunk apertures 92 and into threaded bores 94 which are formed in the axially outwardly facing surface 66 of the cavity 60.

As will be appreciated, the use of a removable adapter 62 permits the adapter 62 to be interchanged with other adapters. This interchangability has several advantages. One advantage is that it permits the manufacturer to produce a "standard" housing 26 which, through the choice of an appropriate adapter 62, will accept a relatively large number of nozzles types. Another advantage is that the removability of the adapter 62 permits the user to remove and replace the adapter 62 with a new adapter 62 when and if the adapter 62 becomes worn out. A third advantage is that the adapter 62 and cavity 60 are designed so that different types of adapters 62 are interchangeable within the same cavity 60 and housing 26 structure. This interchangablilty of adapter 62 types is especially useful in cases wherein a ship is refitted with a different type of nozzle. Without this interchangability, the use of a different type of nozzle 20 would force the user to replace the entire housing structure 26. As can be appreciated, this interchangability of the adapter 62 substantially reduces the cost of refitting a ship with a different nozzle type.

A movable gate means is provided for securing the nozzle 20 on to the apparatus 10. The primary components of the gate means include first and second tracks 100, 102 which are formed in the second end 30 of the valve housing portion 32, and first and second gate members 106, 108 which engage the nozzle 20, and are slidable along the tracks 100, 102 between a nozzle releasing position (shown in solid in FIG. 4) and a nozzle engaging position (shown in a phantom in FIG. 4). In the nozzle releasing position, the gate members 106, 108 are moved radially outwardly away from the cavity 60 to permit the nozzle 20 to be inserted into, and removed from the cavity 60 without obstruction. In the nozzle engaging position, the gate members 106, 108 are moved radially inwardly against the barrel portion 110 of the nozzle to grip the barrel portion 110, thereby securing the nozzle 20 to the apparatus 10.

The first and second tracks 100, 102 extend in a generally parallel relation across the second end 30 of the valve housing portion 32. The tracks 100, 102 have a generally truncated triangular dovetail cross section to receive the truncated triangular cross sectioned first and second track followers 112, 114, respectively, of each of the first and second gate members 106, 108. As will be appreciated, the truncated triangular cross sectional shape of the tracks 100, 102 and track followers 112, 114 permits the gate members 106, 108 to move along the track 100, 102, while preventing the gate members 106, 108 from moving in an axial direction, and thus becoming disengaged from the valve housing portion 32.

First and second truncated bores 116, 118 are formed in each of the first and second tracks 100, 102. As will be explained in more detail below, the truncated bores 116, 118 serve as a detent receiving means, to help maintain the gate members 106, 108 in their proper relative positions on the first and second tracks 100, 102.

In addition to the first and second track followers 112, 114, the first and second gate members 106, 108 each include a radially inwardly facing mating surface 122 and a detent means 124. The mating surface 122 includes a generally planar gate member mating portion 126 which mates with and abuts against the corresponding mating surface portion 126 of the other gate member 106 or 108. The mating surface 122 also includes a nozzle engaging surface 128 which is shaped, sized and positioned to grip the barrel portion 110 of the nozzle 20. In the embodiment shown in FIGS. 1–6, the nozzle engaging surface 128 has a concave, hemi-cylindrical shape, which is sized appropriately to engage the generally cylindrically shaped barrel portion 110 of the Variable nozzle 20.

As best shown in FIG. 2, a concave, arcuate lip surface segment 132 is formed on each gate member 106, 108 adjacent to the lower edge of the nozzle engaging surface 128. When the gate members 106, 108 are in their nozzle engaging positions, the arcuate lip surface segments 132 form an annular lip surface which grips a lip 136 (FIG. 1) formed on the nozzle 20. Referring back to FIG. 2, it will be noticed that a portion of each lip surface segment 132 is positioned axially outwardly of the nozzle lip 136, and a portion of each lip surface segment 132 is disposed radially outwardly of the nozzle lip 136. The axially outward positioning of a portion of each lip surface segment 132 helps to secure the nozzle 20 to the apparatus 10 by preventing axially directed movement of the nozzle 20. As can be appreciated, the force of the water (or other fluid) emerging from the nozzle 20 exerts a relatively strong axially outwardly directed force on the nozzle 20. The axially outwardly positioned portions of the lip surface segments 132 act against this axially outwardly directed force.

Preferably, the lip surface segments 132 are sized to exert an axially inwardly directed force against the nozzle lip 136. This axially inwardly directed force results from the lip surface segments 132 of the relatively non-deformable gate members 106, 108 being sized slightly smaller than the lip 136, so that when the gate members 106, 108 are in their nozzle engaging position the lip surface segments 132 slightly deform the relatively deformable rubber nozzle lip 136. The axially inwardly directed force exerted by the lip surface segments 132, helps to force the end face 78 of the nozzle 20 into a tight engagment with the ridged portion 82 of the axially outwardly facing surface 76 of the adapter 62, thereby promoting a generally watertight engagement between the end face 78 of the nozzle 20 and the adapter 62, and hence the nozzle 20 and the apparatus 10.

Figure 3:
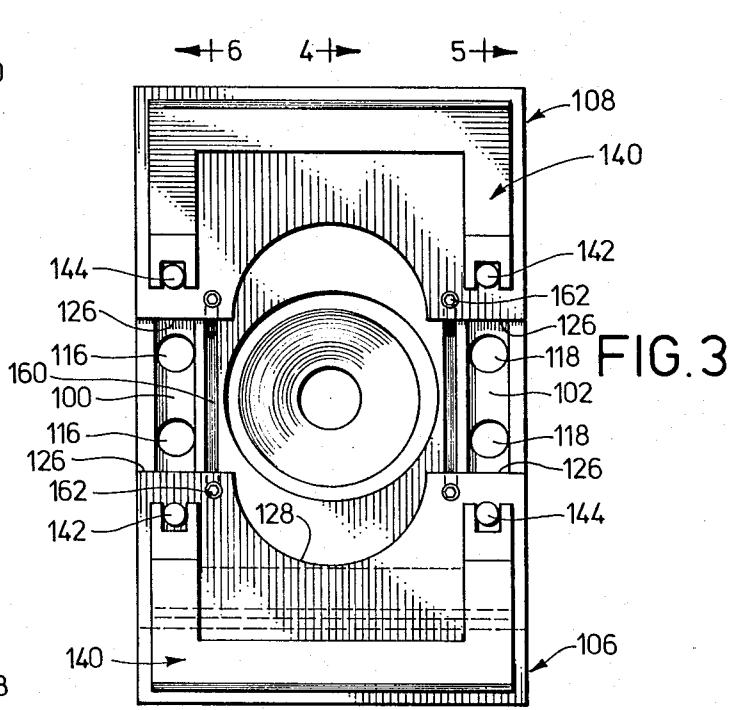
FIG. 3 is an end view of the present invention.
Figure 4:
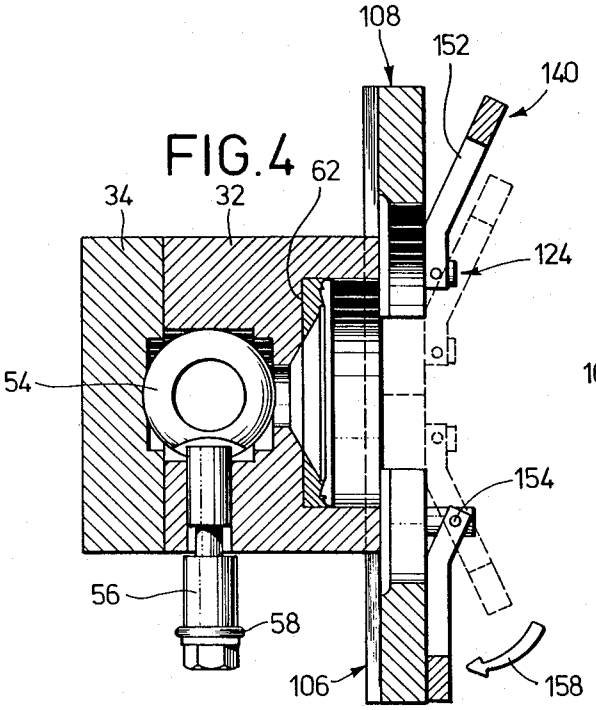
FIG. 4 is a sectional view taken along lines 4—4 of FIG. 3.
Figure 5:
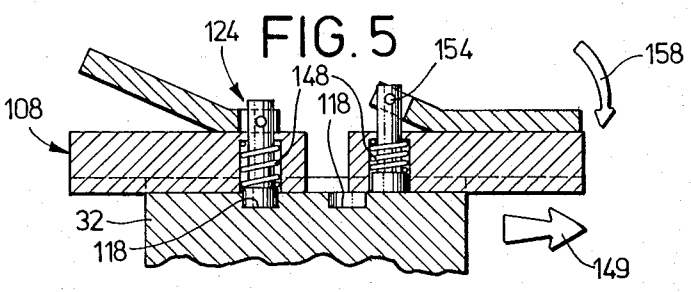
FIG. 5 is a sectional view taken along lines 5—5 of FIG. 3.

As best shown in FIGS. 3, 4, and 5, the detent means 124 for each gate member 106, 108 includes a U-shaped lever member 140, first and second detent pins 142, 144 and a spring biasing means, such as compression spring 148, for each of the detent pins 142, 144. Each of detent pins 142, 144 extends axially through the gate member 106, 108 and is biased axially inwardly by the compression spring 148 into engagment with the axially outwardly facing, planar surface of the track 100 or 102. When positioned over the truncated bores 116, 118, (the detent receiving means), the detent pins 142, 144 are biased by the spring 148 to engage the particular bore 116, 118 over which it is placed, to prevent movement of the gate members 106, 108 in a radial direction indicated generally by arrow 149. The truncated bores 116, 118 are positioned to receive the detent pins 142, 144 when the gate members 106, 108 are in the nozzle engaging position. By maintaining the gate members 106, 108, in the nozzle engaging position, the engagement of the detent pins 142, 144, and truncated bores 116, 118 prevents the nozzle 20 from becoming disengaged from the apparatus 10. Additionally, as the gate members 106, 108 lock the nozzle 20 onto the apparatus 10, the operator is freed to perform other tasks.

The lever member 140 includes a generally planar top leg portion 150, and a pair of angled side leg portions 152. A transverally extending pin 154 pivotably couples the angled side leg portions 152 to the detent pins 142 or 144.

Figure 6:
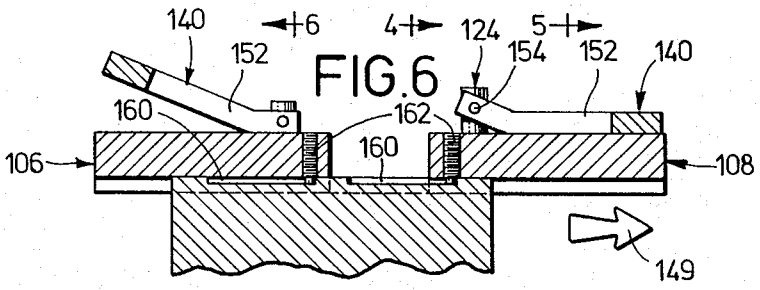
FIG. 6 is a sectional view taken along lines 6—6 of FIG. 3.

As best shown in FIGS. 5 and 6, when the detent pins 142, 144 are received in their truncated bores 116 or 118, the angle in the angled side leg portion 152 causes the top leg portion 150 of the lever member 140 to be placed in a spaced relation from the top surface of its gate member 106, or 108. To disengage the detent pins 142, 144, the raised top leg portion 150 is moved toward the top surface of the gate member 106, 108 as indicated generally by arrow 158.

A limit means is provided for limiting the extent to which the gate members 106, 108 can move along the tracks 100, 102. The limit means includes a pair of slots 160 which are formed in the second end surface 30 of the valve housing portion 32, and which extend alongside, and parallel to the tracks 100, 102. Removable studs 162 extend axially through the gate members 106, 108, and into the slots 160. The engagement of the studs 162 with the slots 160 permits gate members 106, 108 to move in a radial direction (as indicated by arrow 149) only to the point wherein the studs 162 engage the end of the slot 160. This end position is indicated by the position of gate member 108 of FIG. 6. As best shown in FIG. 4, the limit means permits gate member 106 to radially outwardly to a point wherein the gate member 106 prevents the valve handle 58 from being moved to its valve open position, parallel to passageway 52. This arrangement helps to ensure that the valve 54 will remain in its closed position when the apparatus 10 is not in use, thus helping to maintain the watertight integrity of the compartment.

The sprinkler system 24 is best shown in FIG. 2. The sprinkler system 24 includes a mating pipe 170 having a threaded end 172 for being received by the threaded central bore 36 of the end plate portion 34 of the housing 26. The mating pipe 170 extends through the aperture 40 in the bulkhead 12 into the second compartment 16. A series of other pipes 174 and/or joints 178 can be affixed to the mating pipe 170 as necessary, to conduct fluid from the mating pipe 178 to one or more sprinkling heads 180. Although the sprinkler heads 180 can be placed anywhere in the second compartment 16, there are two preferred locations for the sprinkler head 180.

The first preferred location is adjacent to the door or hatch which connects the two compartments 14, 16. This location is preferred as it helps to facilitate entry by the firefighters into the second compartment 16. If a fire breaks out in the second compartment 16, it is often necessary to enter the second compartment 16. By providing a mist to help extinguish and control the fire in the area of compartment 16 adjacent to the door or hatch connecting the two compartments 14, 16 , the dangers faced by the firefighters when entering into second compartment 16 are reduced substantially. Additionally, providing a shower of water adjacent to the door or hatch reduces the likelihood of the fire in second compartment 16 spreading to first compartment 14, and reduces the intensity of the fire and the temperature of the second compartment 16 when the firefighters enter the second compartment 16. The second preferred location for the sprinkler head 180 is adjacent to any article or device in the second compartment 16 which is particularly likely to be a fire source.

Preferably, the apparatus 10 of the present invention is not used alone, but rather in pairs. In addition to the apparatus 10 shown in FIGS. 1–6 for conducting fluid from first compartment 14 into second compartment 16, a second apparatus (not shown) should be placed on bulkhead 12, in second compartment 16, to conduct water from second compartment 16 into first compartment 14. By using paired apparatuses, a fire can be fought in both (or either) of the first and second compartments 14, 16.

Figure 7:
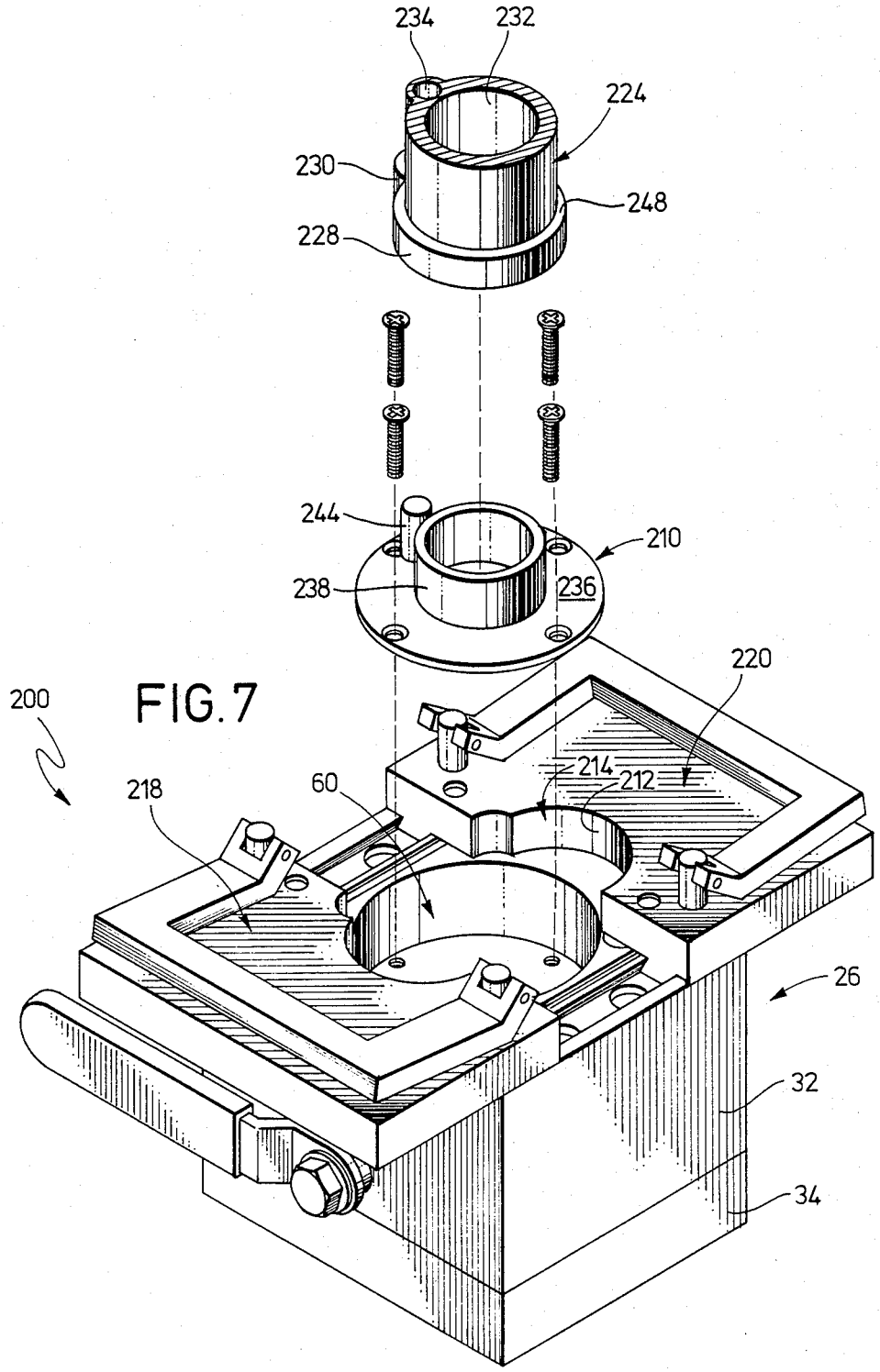
FIG. 7 is a perspective view of an alternate embodiment of the present invention.

An alternate embodiment apparatus 200 is shown in FIG. 7. Apparatus 200 contains a valve housing portion 32 and an end plate 34 which are identical to the valve housing 32 and end plate 34 of the embodiment shown in FIGS. 1–6. However, the apparatus 200 shown in FIG. 7 does include a different adapter 210, and gate members 218, 220 having mating surfaces 214 which have different shaped nozzle engaging portions 212. These differences permit the apparatus 210 to receive a differently configured nozzle, (such as "All-purpose" nozzle 224) in a generally watertight relation.

All-purpose nozzle 224 differs from the Variable nozzle 20 (shown in FIG. 1 and 2) in that the All-purpose nozzle 224 does not have a cylindrical cross section. Rather the All-purpose nozzle 224 has a modified figure eight cross section having a relatively larger diameter portion 228, and a relatively smaller diameter portion 230. The relatively larger diameter portion 228 includes a passageway 232 through which the water flows in the nozzle 224. The relatively smaller diameter portion 230 include a bore 234 which extends axially therethrough, through which water can also flow.

The adapter 210 is configured to secure the All-purpose nozzle 224 to the apparatus 200, and includes a generally planar base 236 for receiving the end face of the nozzle 224. The base 236 is also configured to be received by the cavity 60 of the apparatus 200 (which is identical to the cavity 60 of the apparatus 10 shown in FIGS. 1–6.) An upstanding guide tube 238 extends axailly outwardly from the base surface 236, and is sized and shaped to be received by the passageway 232 of the nozzle 224. By extending into the passageway 232, the tube 238 directs water from the nozzle 224 through the interior of the tube 238, and ultimately into the passageway (not shown) of the housing 26.

An upstanding positioning guide finger 244 extends axially upwardly from the base surface 236. The finger 244 is received by the bore 234 of the smaller diameter portion 230 of the nozzle 224, to position the nozzle 224 properly on the adapter 210. The nozzle engaging portions 212 of the mating surfaces 214 of the gate members 218, 220 have a modified, figure eight configuration to engage the modified, figure eight configured barrel portion of nozzle 224. Lip segments (not shown) can also be formed adjacent to the nozzle engaging portion 214 for overlaying the lip 248 of the nozzle.

Although only two embodiments 10, 200 are shown, it will be appreciated that an identical housing 26 can be adapted, through the use of properly configured gate members and adapters, to fit a wide variety of nozzles. This adaptability can be achieved without reconfiguring the structure of the housing 26. Additionally, it will be appreciated that the apparatuses 10, 210 have utility in compartmentalized structures other than ships. For example, the apparatus of the present invention would be useful on off-shore oil drilling rigs and in industrial plants. It will also be appreciated that the adjacent second compartment 16 into which the fluid from the nozzle 20 is directed by the apparatus 10 need not be the compartment next to the first compartment 14. Rather the second compartment 16 can be an adjacent compartment two or three compartments away from the first compartment.

Having described the invention in detail, and by reference to the preferred embodiments thereof, it will be apparent that modifications and variations are possible without departing from the scope of the invention as defined in the appended claims.

What is claimed is:

1. A safe entry apparatus mountable in a first compartment on a wall in a structure containing the first compartment and a second compartment, the apparatus being provided for receiving a nozzle to permit a fluid from the nozzle to be transferred into the second compartment, the apparatus comprising:

a housing having a first end, a second end, and a passageway extending between the first end and the second end, a valve means in fluid communication with the passageway, including a handle means for the operator to move the valve means between a closed position to prevent the flow of fluid between the first and second compartments and an opened position to permit the flow of fluid between the first and second compartments, a nozzle receiving means disposed adjacent to the second end of the housing for receiving the nozzle, the nozzle receiving means including a cavity into which the nozzle can be inserted, the cavity including an aperture in fluid communication with the passageway, a gate means mounted to the housing and movable between, and stationary positioned in each of a nozzle releasing position to permit the nozzle to be received into the cavity, and a nozzle engaging position for gripping the nozzle to secure the nozzle in the cavity.

2. The invention of claim 1 wherein said nozzle receiving means includes a removable adapter means mounted in the cavity, the adapter means including an axially outwardly facing surface contoured for receiving an end of the nozzle in a generally watertight relation.

3. The invention of claim 2 wherein said adapter means includes an aperture for placing the adapter means in fluid communication with said passageway, and further comprising a removable fastener means for fastening the adapter means to the housing.

4. The invention of claim 2 wherein said cavity includes a generally planar axially outwardly facing surface and a generally right cylindrical, radially inwardly facing surface, and said adapter means includes a generally planar radially inwardly facing surface matable with the planar axially outwardly facing surface of said cavity.

5. The invention of claim 2 wherein said adapter means includes a guide means engageable with the nozzle for positioning the nozzle on the adapter means.

6. The invention of claim 5 wherein said guide means comprises a tube insertable into an aperture in the nozzle.

7. The invention of claim 1 wherein said cavity includes a generally planar axially outwardly facing surface, and said nozzle receiving means includes a removable adapter means, the removable adaptor means including a generally planar axially inwardly facing surface matable with the axially outwardly facing surface of the cavity, an axially outwardly facing surface contoured to receive the nozzle in a generally water-tight relation, and an aperture extending through the adapter to place the nozzle in fluid communication with said passageway.

8. The invention of claim 1 wherein said gate means comprises first and second gate members slidably mounted to said housing for movement between the nozzle releasing position and the nozzle engaging position.

9. The invention of claim 1 wherein said gate means comprises first and second gate members movably mounted to said housing for movement between the nozzle releasing position and the nozzle engaging position, each of said gate members including an arcuate lip surface for engaging an axially outwardly facing surface of the nozzle.

10. The invention of claim 9 wherein said lip surface comprises a generally concave surface, the lip surfaces of the first and second gate members being positionable to form a generally annular concave lip surface when said gate members are in the nozzle engaging position.

11. The invention of claim 9 wherein said first and second gate members each include a radially inwardly facing surface for engaging a side surface of the nozzle.

12. The invention of claim 1 wherein said second end of said housing includes a track means, and said gate means comprises first and second gate members, each of the first and second gate members including a track follower means slidable along the track means to permit the gate members to move between the nozzle releasing position and the nozzle engaging position.

13. The invention of claim 12 wherein said track means and track follower means each have a generally triangular cross-section.

14. The invention of claim 12 wherein the track means is formed as a part of the housing means.

15. The invention of claim 1 wherein said gate means comprises first and second gate members movably mounted to said housing for movement between the nozzle releasing position and the nozzle engaging position, each of the first and second gate members including a radially inwardly facing surface shaped and positioned to snugly engage a side surface of the nozzle.

16. The invention of claim 1 wherein said nozzle receiving means includes a removable adapter means having an axially outwardly facing surface, the axially outwardly facing surface including a beveled portion and a face engaging portion disposed radially outwardly from the beveled portion, the face engaging portion including at least one ridge for engaging a portion of the face of the nozzle in a generally watertight relation.

17. A safe entry apparatus mountable in a first compartment on a wall separating the first compartment from a second compartment, the apparatus being provided for receiving a nozzle to permit a fluid from the nozzle to be transferred into the second compartment, the apparatus comprising:

a housing having a first end, a second end, a passageway extending between the first end and the second end, a nozzle receiving means including a cavity into which an end of the nozzle can be inserted, and an aperture in fluid communication with the passageway, a track means including a detent receiving means, a removable adapter means insertable in the cavity, the adapter means including an axially outwardly facing surface contoured for receiving an end of the nozzle in a generally watertight relation, and a first gate member and a second gate member, each of the first and second gate members including a track follower means slidable along the track means to permit said gate members to move between a nozzle releasing position and a nozzle engaging position, the first gate member including a detent means engagable with the detent receiving means for fixing the gate member in a selected position on the track means.

18. A safe entry apparatus mountable in a first compartment on a wall in a structure containing the first compartment and a second compartment, the apparatus being provided for receiving a nozzle to permit a fluid from the nozzle to be transferred into the second compartment, the apparatus comprising:

a housing having a first end, a second end, and a passageway extending between the first end and the second end, a nozzle receiving means disposed adjacent to the second end of the housing for receiving the nozzle, the nozzle receiving means including a cavity which the nozzle can be inserted, the cavity including a generally planar axially outwardly facing surface, and an aperture in fluid communication with the passageway, the nozzle receiving means including a removable adaptor means, the removable adaptor means including a generally planar axially inwardly facing surface matable with the axially outwardly facing surface of the cavity, an axially outwardly facing surface contoured to receive the nozzle in a generally snug relation, and an aperture extending through the adaptor means to place the nozzle in fluid communication with said passageway, the adaptor means including an axially outwardly extending guide tube sized for being received by the nozzle, the guide means guide means being aligned with said aperture of said adaptor for directing fluid from the nozzle to said passageway in said housing, and a gate means mounted to the housing and movable between a nozzle releasing position to permit the nozzle to be received in the cavity, and a nozzle engaging position for gripping the nozzle to secure the nozzle in the cavity.

19. A safe entry apparatus mountable in a first compartment on a wall in a structure containing the first compartment and a second compartment, the apparatus being provided for receiving a nozzle to be transferred into the second compartment, the apparatus comprising:

a housing having a first end, a second end, and a passageway extending between the first end and the second end, the second end of the housing having a track means, the track means including at least one of a detent receiving means and a detent means, a nozzle receiving means disposed adjacent to the second end of the housing for receiving the nozzle, the nozzle receiving means including a cavity into which the nozzle can be inserted, the cavity including an aperture in fluid communication with the passageway, at least one gate member mounted to the housing and movable between a nozzle releasing position to permit the nozzle to be received into the cavity, and a nozzle engaging position for gripping the nozzle to secure the nozzle in the cavity, the at least one gate member including a track follower means slidable along the track means to permit the at least one gate member to move between the nozzle releasing position and the nozzle engaging position, and at least one of a detent means and a detent receiving means for maintaining the at least one gate member in a selected position on the said track means.

20. The invention of claim 19 wherein detent means includes a biasing means for biasing the detent means into engagement with said detent receiving means, and a lever means for moving said detent means out of engagement with said detent receiving means.

21. The invention of claim 19 wherein said detent means is mounted to said at least one gate member, and said detent receiving means is on said track means.

22. A safe entry apparatus mountable in a first compartment on a wall in a structure containing the first compartment and a second compartment, the apparatus being provided for receiving a nozzle, the nozzle including a barrel portion having a diameter, and terminal lip portion having a diameter greater than the diameter of the barrel portion, the lip portion including radially outwardly facing surface and an axially outwardly facing surface disposed between the barrel portion and the radially outwardly facing surface of the lip portion, the nozzle being receivable to permit a fluid from the nozzle to be transferred into the second compartment, the apparatus comprising:

a housing having a first end, a second end, and a passageway extending between the first end and the second end, a nozzle receiving means disposed adjacent to the second end of the housing for receiving the nozzle, the nozzle receiving means including a cavity into which the nozzle can be inserted, the cavity including an aperture in fluid communication with the passageway, a gate means mounted to the housing, and movable between, and stationary positioned in each of a nozzle releasing position to permit the nozzle to be received into the cavity, and a nozzle engaging position for gripping the nozzle to secure the nozzle in the cavity.

23. The invention of claim 22 further comprising a track means and wherein the gate means comprises at least one gate member having a track follower means slidable along the track means to permit the at least one gate member to move between the nozzle engaging and the nozzle releasing positions.

24. The invention of claim 22 further comprising a detent means and a detent receiving means, one of the detent means and detent receiving means being disposed on the gate means and the other of the detent means and detent receiving means being disposed on the housing, the detent means and detent receiving means being engageable for fixing the position of the gate means.

25. The invention of claim 24 further comprising a track means, and wherein the gate means comprises at least one gate member having a track follower means slidable along the track means to permit the at least one gate member to move between the nozzle engaging and the nozzle releasing positions.

26. The invention of claim 22, further comprising a valve means in fluid communication with the passageway, the valve means movable between a closed position to prevent the flow of fluid between the first and second compartments, and an opened position to premit the flow of fluid between the first and second compartments.

* * * * *